US006066914A

United States Patent [19]

Shimizu et al.

[11] Patent Number: 6,066,914

[45] Date of Patent: May 23, 2000

[54] COLOR CATHODE RAY TUBE

[75] Inventors: Norio Shimizu; Shinichiro Nakagawa, both of Fukaya; Masatsugu Inoue, Kumagaya, all of Japan

[73] Assignee: Kabushiki Kaisha Toshiba, Kawasaki, Japan

[21] Appl. No.: 09/207,657

[22] Filed: Dec. 9, 1998

[30] Foreign Application Priority Data

| | | | |
|---|---|---|---|
| Dec. 10, 1997 | [JP] | Japan | 9-339763 |
| Feb. 9, 1998 | [JP] | Japan | 10-026841 |
| Nov. 9, 1998 | [JP] | Japan | 10-317637 |

[51] Int. Cl.[7] ..... H01J 29/10

[52] U.S. Cl. ..... 313/477 R; 313/467; 313/461

[58] Field of Search ..... 313/402, 461, 313/467, 477 R, 408

[56] References Cited

U.S. PATENT DOCUMENTS

| | | | |
|---|---|---|---|
| 2,728,012 | 12/1955 | Swedlund . | |
| 4,537,322 | 8/1985 | Okada et al. . | |
| 5,216,321 | 6/1993 | Kawamura et al. . | |
| 5,532,545 | 7/1996 | Okamoto et al. | 313/407 |
| 5,536,995 | 7/1996 | Sugawara et al. . | |
| 5,663,610 | 9/1997 | Inoue et al. | 313/461 |

FOREIGN PATENT DOCUMENTS

WO 97/33298 12/1997 WIPO .

OTHER PUBLICATIONS

O. Adachi, et al., SID International Symposium Digest of Technical Papers, vol. 22, pp. 37–40, "Super–Flate–Face Large–Size–Screen Color CRT", May 6, 1991.

*Primary Examiner*—Nimeshkumar D. Patel
*Assistant Examiner*—Todd Reed Hopper
*Attorney, Agent, or Firm*—Oblon, Spivak, McClelland, Maier & Neustadt, P.C.

[57] ABSTRACT

A color cathode ray tube comprises a panel having an effective portion. The outer surface in the effective portion of the panel is substantially flat or forms a slightly curved plane with a small curvature. The inner surface of the panel has a substantially infinite curvature radius in a direction of the longer axis in at least a central portion of the panel and is curved in a direction of the shorter axis. A difference in thickness of the effective portion of the panel between the central portion and the edge portions diagonally apart from each other exceeds 8 mm and does not exceed 20 mm, and the transmittance of the glass in the central portion of the effective portion is at least 70%. The particular construction enables the vacuum envelope of the color cathode ray tube to exhibit a mechanical strength high enough to sufficiently withstand the atmospheric pressure, though the effective portion of the panel is flattened. The vacuum envelope also exhibits a mechanical strength high enough to hold the curved surface of the shadow mask. Further, deterioration of brightness can be prevented in the color cathode ray tube of the present invention.

10 Claims, 4 Drawing Sheets

COLOR CATHODE RAY TUBE

BACKGROUND OF THE INVENTION

The present invention relates to a color cathode ray tube, particularly, to a color cathode ray tube having a panel with improved flatness of the effective region, having a vacuum envelope exhibiting a mechanical strength high enough to fully withstand the atmospheric pressure and to fully maintain a curved surface of the shadow mask, and exhibiting a satisfactory brightness at the peripheral portion of the panel.

In general, a color cathode ray tube comprises a vacuum envelope 4 consisting of a glass panel 3 and a funnel, as shown in FIG. 1. In the panel 3, a skirt portion 2 is formed at the peripheral portion of a face plate 1 having a curved surface and a substantially rectangular effective portion. The glass funnel is bonded to the skirt portion 2 of the panel 3 so as to constitute the vacuum envelope 4. A phosphor screen 5 consisting of a black material layer which does not emit light and three-color phosphor layers is formed on the inner surface of an effective portion 1 of the face plate. A shadow mask 9 is arranged inside the panel 3 in a manner to face the phosphor screen 5. The shadow mask 9 consists of a mask body 7 having a substantially rectangular effective face 6 and having a large number of electron beam-passing holes formed therein and a mask frame 8 arranged in a peripheral portion of the mask body 7. On the other hand, an electron gun assembly 11 is arranged within a neck 10 of the funnel. Three electron beams 12B, 12G, 12R emitted from the electron gun assembly 11 are deflected by the magnetic field generated from a deflecting device 13 mounted outside the funnel so as to scan the phosphor screen 5 in both horizontal and vertical directions via the shadow mask 9, with the result that a color picture image is displayed on the rectangular effective face 6.

For displaying a color picture image free from color deviation on the phosphor screen 5 in the color cathode ray tube described above, the electron beams 12B, 12G, 12R passing through the electron beam-passing holes formed in the mask body 7 of the shadow mask 9 are required to perform landing accurately on the three-color phosphor layers of the phosphor screen 5. To meet this requirement, it is necessary to maintain accurately the positional relationship between the panel 3 and the shadow mask 9.

In order to improve the visibility of the color cathode ray tube, the outer surface in the effective area of the panel is required in recent years to be flattened to have a very small curvature. The curvature in the inner surface of the effective area is also required to be diminished in view of the moldability of the panel and the visibility of the color cathode ray tube.

However, in a color cathode ray tube having a flattened panel as described above, a serious problem to be considered is whether the vacuum envelope including the particular panel has a mechanical strength high enough to withstand the atmospheric pressure. If the thickness of the panel is increased in an attempt to ensure a mechanical strength high enough to withstand the atmospheric pressure, the transmittance of the effective portion is lowered, leading to deterioration of brightness.

Further, for permitting the electron beams to land accurately on the three-color phosphor layers of the phosphor screen 5 mounted on the inner surface of the effective portion of the panel, the effective surface of the mask body having the electron beam-passing holes formed therein is required to have a curvature diminished appropriately to conform with the inner surface in the effective portion of the panel. However, if the curvature in the effective surface of the mask body is diminished, the mechanical strength serving to keep the mask curvature unchanged is deteriorated, leading to deformation of the shadow mask. As a result, the color purity is likely to be deteriorated.

It should also be noted that, because of the operating principle of the color cathode ray tube of shadow mask type, the electron beam reaching the phosphor screen through the electron beam-passing holes of the shadow mask is at most ⅓ of all the electron beams emitted from the electron gun. The remaining electron beams, which do not pass through the beam-passing holes of the shadow mask, impinge on the shadow mask so as to be converted into a heat energy and, thus, to heat the shadow mask. When heated, the shadow mask is thermally expanded so as to bring about a doming problem that the effective area of the shadow mask is swollen toward the phosphor screen. As a result, the distance between the inner surface in the effective portion of the panel and the effective area of the mask body is changed. If the change in the distance exceeds an allowable range, the electron beam fails to land accurately on the phosphor layer, leading to deterioration of the color purity. The magnitude of the mis-landing caused by the thermal expansion of the shadow mask depends on the brightness of the image pattern, the continuing time of the image pattern, etc. Particularly, in the case of locally displaying an image pattern of a high brightness, a local doming problem takes place, giving rise to a large local mis-landing in a short time.

The mis-landing caused by the local doming problem is increased where the curvature is diminished in the effective area of the mask body. It follows that it is unavoidable to cope with the deterioration of the color purity caused by the local doming problem in order to flatten the effective area of the panel. It should also be noted that, if the outer surface alone in the effective portion of the panel is flattened, it is unavoidable for a difference in thickness between central portion and the peripheral portion of the panel to be increased, giving rise to a large difference in the light transmittance between the central portion and the peripheral portion of the panel. Naturally, a difference in brightness between the central portion and the peripheral portion of the panel is also increased, giving rise to deterioration in visibility of the cathode ray tube.

As described above, if the curvature of the outer surface in the effective portion of the panel is much diminished to make the outer surface close to a flat surface in order to improve the visibility of the cathode ray tube, a serious problem is raised in terms of the mechanical strength of the vacuum envelope because the vacuum envelope is required to withstand the atmospheric pressure. On the other hand, if the thickness of the panel is increased in an attempt to allow the vacuum envelope to withstand the atmospheric pressure, the transmittance in the effective portion is lowered, leading to deterioration of the brightness.

Further, if the curvature in the effective portion of the mask body is diminished to conform with the flattening in the effective portion of the panel, the mechanical strength serving to hold the curved surface of the mask body is lowered, giving rise to various problems such as deformation of the shadow mask, and deterioration of the color purity resulting from mis-landing of the electron beam caused by a local doming problem.

BRIEF SUMMARY OF THE INVENTION

An object of the present invention is to provide a color cathode ray tube having a panel whose effective portion is flattened, having a vacuum envelope maintaining a mechanical strength high enough to withstand the atmospheric pressure and high enough to hold the curved surface of the shadow mask, and capable of preventing the brightness from being lowered.

(1) According to an aspect of the present invention, there is provided a color cathode ray tube, comprising a panel made of glass and having a substantially rectangular effective portion, a phosphor screen formed on the inner surface of the effective portion of the panel and consisting of three-color phosphor layers, and a shadow mask positioned to face the phosphor screen and having a large number of electron beam passing-holes formed in a substantially rectangular effective portion thereof, wherein the outer surface in the effective portion of the panel is substantially flat or forms a slightly curved plane with a small curvature, a difference in thickness of the effective portion of the panel between the central portion and the edge portions diagonally apart from each other exceeds 8 mm and does not exceed 20 mm, and the transmittance of the glass in the central portion of the effective portion is at least 70%.

(2) According to another aspect of the present invention, there is provided a color cathode ray tube, comprising a panel made of glass and having a substantially rectangular effective portion, a phosphor screen formed on the inner surface of the effective portion of the panel and consisting of three-color phosphor layers, and a shadow mask positioned to face the phosphor screen and having a large number of electron beam passing-holes formed in a substantially rectangular effective portion thereof, wherein the outer surface in the effective portion of the panel is substantially flat or forms a slightly curved plane, a difference in thickness of the effective portion of the panel between the central portion and the edge portions diagonally apart from each other exceeds 8 mm and does not exceed 20 mm, the transmittance of the glass in the central portion of the effective portion is at least 70%, and the three-color phosphor layers are formed inside the effective portion of the panel with a filter interposed between the inner surface of the panel and the three-color phosphor layers, the filter selectively transmitting the light rays emitted from the three-color phosphor layers.

(3) According to another aspect of the present invention, there is provided a color cathode ray tube, comprising a panel made of glass and having a substantially rectangular effective portion, a phosphor screen formed on the inner surface of the effective portion of the panel and consisting of three-color phosphor layers, and a shadow mask positioned to face the phosphor screen and having a large number of electron beam passing-holes formed in a substantially rectangular effective portion thereof, wherein the outer surface in the effective portion of the panel is substantially flat or forms a slightly curved plane, a difference in thickness of the effective portion of the panel between the central portion and the edge portions diagonally apart from each other exceeds 8 mm and does not exceed 20 mm, the transmittance of the glass in the central portion of the effective portion is at least 70%, and a filter which changes the transmittance of the glass is formed on the outer surface of the effective portion of the panel.

(4) According to another aspect of the present invention, there is provided a color cathode ray tube, comprising a panel made of glass and having a substantially rectangular effective portion, a phosphor screen formed on the inner surface of the effective portion of the panel and consisting of three-color phosphor layers, and a shadow mask positioned to face the phosphor screen and having a large number of electron beam passing-holes formed in a substantially rectangular effective portion thereof, wherein the outer surface in the effective portion of the panel is substantially flat or forms a slightly curved plane, the inner surface of the panel has a substantially infinite curvature radius in a direction of the longer axis in at least a central portion of the panel and is curved in a direction of the shorter axis such that a difference in thickness of the effective portion of the panel between the central portion and the edge portions diagonally apart from each other exceeds 8 mm and does not exceed 20 mm, and the transmittance of the glass in the central portion of the effective portion is at least 70%.

(5) According to another aspect of the present invention, there is provided a color cathode ray tube, comprising a panel made of glass and having a substantially rectangular effective portion, a phosphor screen formed on the inner surface of the effective portion of the panel and consisting of three-color phosphor layers, and a shadow mask positioned to face the phosphor screen and having a large number of electron beam passing-holes formed in a substantially rectangular effective portion thereof, wherein the outer surface in the effective portion of the panel is substantially flat or forms a slightly curved plane, the inner surface of the panel has a substantially infinite curvature radius in a direction of the longer axis in at least a central portion of the panel and is curved in a direction of the shorter axis such that a difference in thickness of the effective portion of the panel between the central portion and the edge portions diagonally apart from each other exceeds 8 mm and does not exceed 20 mm, the transmittance of the glass in the central portion of the effective portion is at least 70%, and three-color phosphor layers are formed on the inner surface of the effective portion of the panel with a filter interposed therebetween, the filter selectively transmitting the colored light beams emitted from the three-color phosphor layers.

(6) According to another aspect of the present invention, there is provided a color cathode ray tube, comprising a panel made of glass and having a substantially rectangular effective portion, a phosphor screen formed on the inner surface of the effective portion of the panel and consisting of three-color phosphor layers, and a shadow mask positioned to face the phosphor screen and having a large number of electron beam passing-holes formed in a substantially rectangular effective portion thereof, wherein the outer surface in the effective portion of the panel is substantially flat or forms a slightly curved plane, the inner surface of the panel has a substantially infinite curvature radius in a direction of the longer axis in at least a central portion of the panel and is curved in a direction of the shorter axis such that a difference in thickness of the effective portion of the panel between the central portion and the edge portions diagonally apart from each other exceeds 8 mm and does not exceed 20 mm, and the transmittance of the glass in the central portion of the effective portion is at least 70%, and a filter which changes the transmittance of the glass is arranged on the outer surface of the effective portion of the panel.

(7) According to another aspect of the present invention, there is provided a color cathode ray tube defined in any of items (4) to (6) above, wherein the inner surface in the effective portion of the panel is slightly curved in a direction of the longer axis in edge portions in a direction of the longer axis.

(8) According to another aspect of the present invention, there is provided a color cathode ray tube defined in any of items (1) to (4) above, wherein a drop amount Hp in the inner surface at the edges in a direction of the longer axis relative to the inner surface in the central portion of the effective area of the panel, a drop amount Vp in the inner surface at the edges in a direction of the shorter axis relative to the inner surface in the central portion of the effective area of the panel, and a drop amount Dp in the inner surface at the edges diagonally apart from each other relative to the inner surface in the central portion of the effective area of the panel are set to meet the relationship: Hp<Vp; Hp<Dp.

(9) According to another aspect of the present invention, there is provided a color cathode ray tube defined in any of items (1) or (4) above, wherein the effective portion of the shadow mask has a substantially infinite curvature radius in at least a central portion in a direction of the longer axis and is curved in a direction of the shorter axis. (10) Further, according to still another aspect of the present invention, there is provided a color cathode ray tube defined in item (9) above, wherein the a drop amount Hm at the edges in a direction of the longer axis relative to the center of the effective portion of the shadow mask, a drop amount Vm at the edges in a direction of the shorter axis relative to the center of the effective portion of the shadow mask, and a drop amount Dm at the edges diagonally apart from each other relative to the center of the effective portion of the shadow mask are set to meet the relationship: Hm<Vm; Hm<Dm.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Let us describe a color cathode ray tube according to one embodiment of the present invention with reference to the accompanying drawings.

Figure 1:
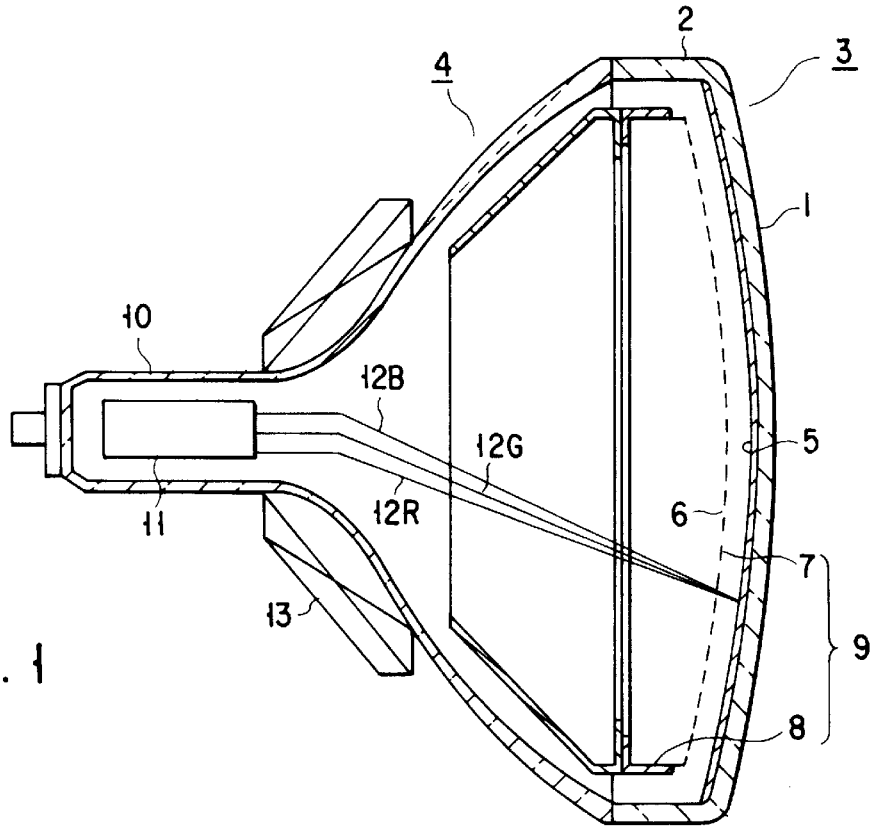
FIG. 1 is a cross sectional view schematically showing the construction of a conventional color cathode ray tube.
Figure 2:
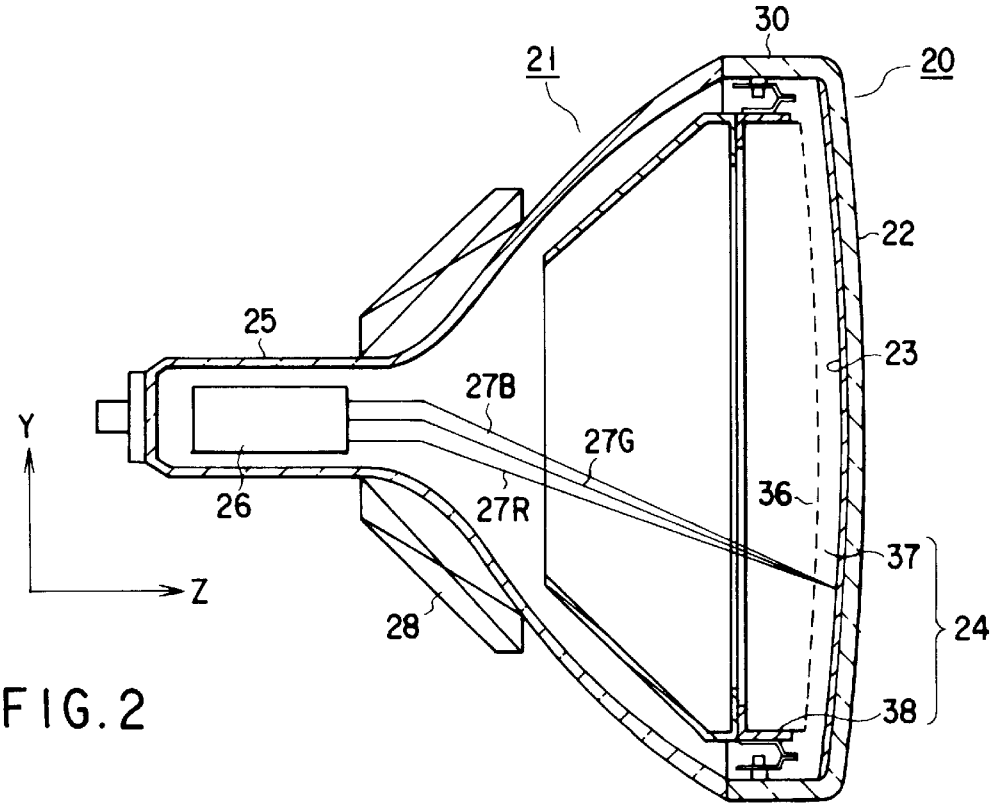
FIG. 2 is a cross sectional view schematically showing the construction of a color cathode ray tube according to one embodiment of the present invention.

FIG. 2 schematically shows the construction of a color cathode ray tube according to one embodiment of the present invention. As shown in FIG. 2, the color cathode ray tube comprises a vacuum envelope consisting of a substantially rectangular panel 20 made of glass and a funnel 21 made of glass. The face plate of the panel 20 has an effective portion 22, which is referred to later. A phosphor screen 23 is formed on the inner surface of the effective portion 22 of the panel 20. Also, a shadow mask 24 is arranged inside the panel 20 to face the phosphor screen 23. On the other hand, an electron gun assembly 26 is arranged within a neck 25 of the funnel 21. Three electron beams 27B, 27G, 27R emitted from the electron gun assembly 26 are deflected by a magnetic field generated from a deflection device 28 mounted outside the funnel 21 so as to scan the shadow mask 24 on the phosphor screen 23 both in the horizontal and vertical directions. As a result, a color picture image is displayed on the effective portion 22 of the panel 20.

The panel 20 includes a skirt portion 30 mounted to the peripheral portion of the face plate having the substantially rectangular effective portion 22, and the funnel 21 is joined to the skirt portion 30.

Figure 3:
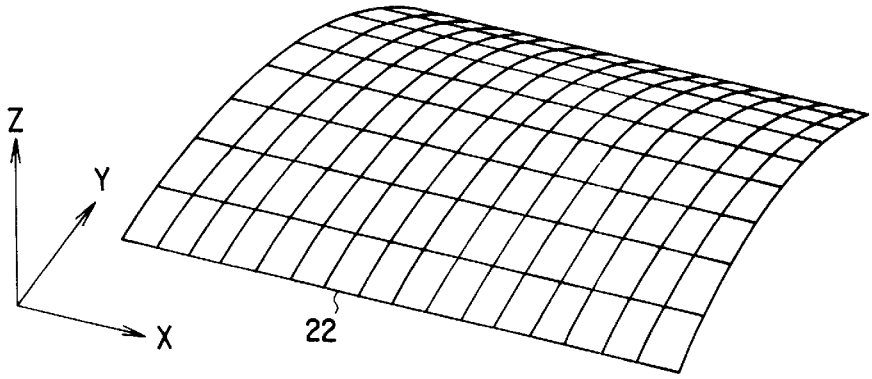
FIG. 3 shows the shape in the inner surface of the mask body of the shadow mask included in the color cathode ray tube shown in FIG. 2.

In the color cathode ray tube of this embodiment, the outer surface of the effective portion 22 of the face plate is formed substantially flat or is slightly curved such that the curvature radius is substantially infinitely large. On the other hand, the inner surface of the effective portion 22 of the face plate is shaped as shown in FIG. 3. Specifically, the inner surface is substantially flat, the curvature radius being substantially infinitely large, in a direction of the longer axis (X-axis) corresponding to the horizontal axis and is curved in a direction of the shorter axis (Y-axis) corresponding to the vertical axis. To be more specific, the inner surface of the effective portion 22 of the face plate is shaped such that the curvature radius is substantially infinitely large in a plane including the longer axis (X-axis) and a tube axis (Z-axis) and a plane parallel to the particular plane, i.e. the X-Z plane. On the other hand, the inner surface is curved in a plane including the shorter axis (Y-axis) and the tube axis (Z-axis) and in a plane parallel to the particular plane, i.e. the Y-Z plane. It follows that the inner surface of the effective portion 22 of the face plate is shaped substantially cylindrical, as shown in FIG. 3.

In the present invention, attentions are paid to the drop amount at the peripheral portion of the inner surface relative to the inner surface in the central portion of the effective portion 22 of the face plate, i.e., to the distance in the axial direction of the tube (Z-axis) between the peripheral portion and the central portion in the inner surface of the effective portion 22 of the face plate. To be more specific, a drop amount Hp in the inner surface at the edges in a direction of the longer axis, i.e., a distance Hp in the axial direction of the tube between the center and the edges in a direction of the longer axis X in the inner surface of the effective portion 22, a drop amount Vp in the inner surface at the edges in a direction of the shorter axis, i.e., a distance Vp in the axial direction of the tube between the center and the edges in a direction of the shorter axis Y in the inner surface of the effective portion 22, and a drop amount Dp in the inner surface at the edges diagonally apart from each other, i.e., a distance Dp in the axial direction of the tube between the center and the edges diagonally apart from each other, are set to meet the relationship: $Hp<Vp$; $Hp<Dp$.

Also, a thickness To in the central portion of the effective portion 22 of the face plate is determined such that a difference $\Delta Tc$ in thickness of the effective portion 22 of the face plate between the central portion having a thickness To and the edge portions each having a thickness Tc diagonally apart from each other exceeds 8 mm and does not exceed 20 mm, i.e., $8\ mm<\Delta Tc=Tc-To\leqq 20\ mm$, so as to allow the effective portion 22 of the face plate to exhibit a light transmittance of at least 70% in the central portion.

Figure 4A:
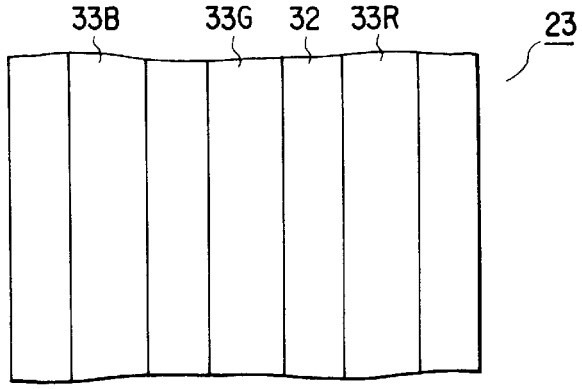
FIGS. 4A and 4B are a plan view and a cross sectional view, respectively, schematically showing collectively the construction of the phosphor screen included in the color cathode ray tube shown in FIG. 2.
Figure 4B:
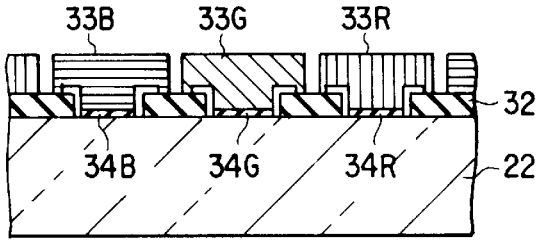

The phosphor screen 23 is formed on the inner surface of the effective portion 22 of the face plate. As shown in FIGS. 4A and 4B, the phosphor screen 23 is a black stripe type phosphor screen comprising slender black layers 32, which do not emit light and extend in a direction of the short axis of the panel 20. Also, three-color phosphor layers 33B, 33G, 33R, which emit blue, green and red light beams, respectively, are buried between adjacent black layers 32.

In this embodiment, color filters 34B, 34G, 34R for the blue, green and red light beams, respectively, are interposed between adjacent black layers 32 which do not emit light. As apparent from, particularly, FIG. 4B, the three-color phosphor layers 33B, 33G, 33G are arranged on the color filters 34B, 34G, 34R, respectively. It should be noted that the color filter 34B, which selectively transmits the blue light beam emitted from the blue light-emitting phosphor layer 33B and absorbs the visible light beams of the other colors, is formed on the blue light-emitting phosphor layer 33B. Also, the color filter 34G, which selectively transmits the green light beam emitted from the green light-emitting phosphor layer 33G and absorbs the visible light beams of the other colors, is formed on the green light-emitting phosphor layer 33B. Further, the color filter 34R, which selectively transmits the red light beam emitted from the red light-emitting phosphor layer 33R and absorbs the visible light beams of the other colors, is formed on the red light-emitting phosphor layer 33R.

The color filter 34B for the blue light is formed of, for example, a cobalt albuminate type pigment or an ultramarine blue pigment. The color filter 34G for the green light is formed of, for example, a $TiO_2$—NiO—CoO—ZnO type pigment, a CoO—$Al_2O_3$—$Cr_2O_3$—$TiO_2$ type pigment, a CoO—$Al_2O_3$—$Cr_2O_3$ type pigment, a $Cr_2O_3$ type pigment, a chlorinated phthalocyanine green type pigment, and a brominated phthalocyanine green type pigment. Further, the color filter 34R for the red light is formed of, for example, a ferric oxide type pigment or an anthraquinone type pigment.

Figure 5:
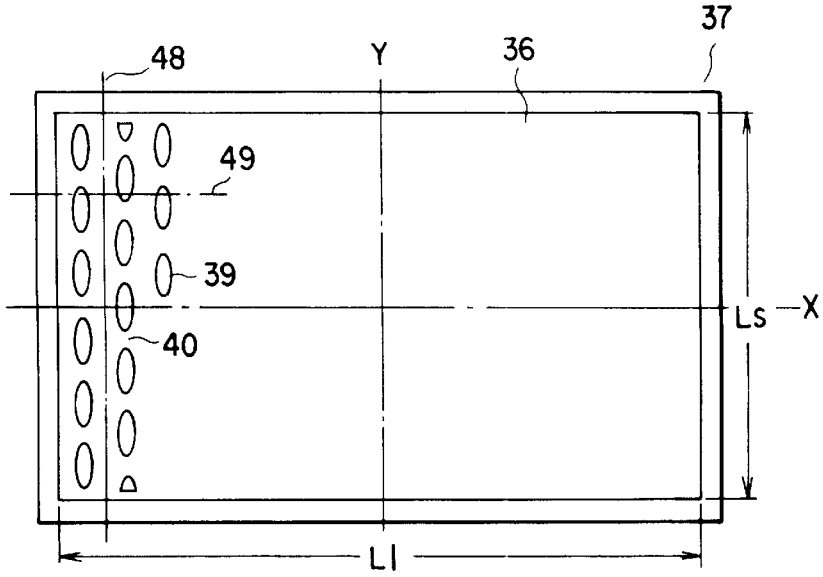
FIG. 5 is a plan view schematically showing the construction in the effective region of the mask body included in the shadow mask shown in FIG. 2.

The shadow mask 24 has an effective area 36 positioned to face the phosphor screen 23. A large number of slit-shaped holes 39 through which pass electron beams are formed in the effective area 23 of the shadow mask 24. The shadow mask 24 consists of a substantially rectangular mask body 37 including the effective area 36 and a substantially rectangular mask frame 38 mounted to the peripheral portion of the mask body 37. As shown in FIG. 5, a plurality of electron beam-passing holes 39 are arranged to form a column in a direction of the shorter axis in the effective area 36 of the mask body 37 with a bridge 40 interposed between adjacent electron beam-passing holes 39. Also, a plurality of such columns are arranged a predetermined distance apart from each other in a direction of the longer axis of the effective area 36 such that the electron beam-passing holes 39 are distributed over the entire region of the effective area 36 of the mask body 37. Further, the electron beam-passing holes 39 included in the adjacent columns are a predetermined distance deviant from each other in a direction of the shorter axis of the effective area 36 of the mask body 37.

It should be noted in particular that, in this embodiment, the effective area 36 of the mask body 37 is substantially flat in a direction of the longer axis (X-axis) such that the curvature radius is substantially infinitely large, and is curved in a direction of the shorter axis (Y-axis). In short, the effective area 36 of the mask body 37 is substantially shaped like a surface of a cylindrical body. In other words, the effective area 36 of the mask body 37 is shaped to conform with the shape of the effective portion 23 in the inner surface of the panel 10. It follows that the effective area 36 of the mask body 37 is shaped such that the curvature radius is substantially infinitely large in a plane including the longer axis (X-axis) and a tube axis (Z-axis) and a plane parallel to the particular plane, i.e. the X-Z plane. On the other hand, the effective area 36 is curved in a plane including the shorter axis (Y-axis) and the tube axis (Z-axis) and in a plane parallel to the particular plane, i.e. the Y-Z plane.

In the present invention, attentions are also paid to the drop amount at the peripheral portion of the effective area 36 of the mask body 37 relative to the central portion of the effective area 36, i.e., to the distance in the axial direction of the tube (Z-axis) between the peripheral portion and the central portion of the effective area 36 of the mask body 37. To be more specific, a drop amount Hm at the edges in a direction of the longer axis, i.e., a distance Hm in the axial direction of the tube between the center and the edges in a direction of the longer axis X of the effective area 36, a drop amount Vm at the edges in a direction of the shorter axis, i.e., a distance Vm in the axial direction of the tube between the center and the edges in a direction of the shorter axis Y of the effective area 36, and a drop amount Dm at the edges diagonally apart from each other, i.e., a distance Dm in the axial direction of the tube between the center and the edges diagonally apart from each other, are set to meet the relationship: $Hm<Vm$; $Hm<Dm$.

In a color cathode ray tube of the construction described above, the effective portion 22 of the panel 20 is flattened so as to improve the visibility of the phosphor screen. As a result, even if the effective area 36 of the mask body 37 included in the shadow mask 24 is also flattened, it is possible to ensure a mechanical strength of the vacuum envelope high enough to withstand the atmospheric pressure and a mechanical strength high enough to hold the curved surface of the shadow mask 24. In addition, it is possible to obtain a sufficiently high brightness at the peripheral portion of the panel 20. It follows that the color purity is unlikely to be deteriorated by the deformation or local doming problem of the shadow mask 24 in the color cathode ray tube of the present invention.

As described previously, the outer surface in the effective portion of the panel is made flat or is curved only slightly so as to improve the visibility of the phosphor screen in the color cathode ray tube of the present invention. On the other hand, it is known to the art that the inner surface in the effective portion of the panel is shaped spherical, cylindrical such that the curvature radius of the inner surface is set at a substantially infinitely large value in a direction of the shorter axis and that the inner surface is curved in a direction of the longer axis, or the inner surface is curved such that the shape of the curve is represented by a polynominal expression of a fourth degree or a sixth degree.

Concerning the shape of the effective portion of the panel, Japanese Patent Application No. 8-49030 discloses a panel which is defined such that the outer surface in the effective portion of the panel is made substantially flat, and the inner surface of the panel is shaped cylindrical, that is, the curvature radius of the inner surface is set at a substantially infinitely large value in a direction of the shorter axis, and the inner surface is curved in a direction of the longer axis.

Where the outer surface is completely flat or where the average curvature radius R is at least 10,000 mm at the edges diagonally apart from each other relative to the center of the effect portion of the panel, the outer surface is defined to be substantially flat.

The average curvature, which is a criterion of a mechanical strength enabling the vacuum envelope to withstand the atmospheric pressure, is defined by the formula:

$$1/Rmax+1/Rmin$$

where Rmax represents the maximum curvature radius of the curved plane, and Rmin represents the minimum curvature radius of the curved plane.

In general, it is known to the art that, where the drop amount at the edges diagonally apart from each other, said drop amount being for calculating the R representation which provides a criterion of the flatness, is the same, the cylindrical curved surface, in which the curvature radius of the inner surface of the effective portion is substantially infinitely large in a direction of the longer axis and the inner surface has a certain curvature radius in a direction of the shorter axis as in the embodiment described above, has the largest average curvature among various curved surfaces. It follows that, if the flatness is substantially the same, the highest mechanical strength withstanding the atmospheric pressure can be obtained in the case where the inner surface of the effective portion 22 is shaped cylindrical such that the curvature radius of the inner surface of the effective portion 22 is substantially infinitely large in a direction of the longer axis and the inner surface has a certain curvature.

Further, it is possible to improve the mechanical strength of the vacuum envelope withstanding the atmospheric pressure without impairing the visibility of the phosphor screen by allowing the inner surface of the effective portion 22 to have a slight curvature in a direction of the longer axis at the peripheral portions in a direction of the longer axis while leaving the curvature radius in a direction of the shorter axis unchanged. In general, the inner surface in the effective portion 22 of the panel 20 is set to meet the relationship: $Hp<Vp$; $Hp<Dp$, where Hp denotes the drop amount of the inner surface at the edges in a direction of the longer axis relative to the center of the effective portion 22, Vp denotes the drop amount of the inner surface at the edges in a direction of the shorter axis relative to the center of the effective portion 22, and Dp denotes the drop amount of the inner surface at the edges diagonally apart from each other relative to the center of the effective portion 22.

On the other hand, the reflection of the external light in the image display section of a color cathode ray tube takes place mainly from the outer surface and inner surface in the effective portion of the panel and from the phosphor layer. Particularly, the greatest reflection takes place from the phosphor layer.

Figure 6A:
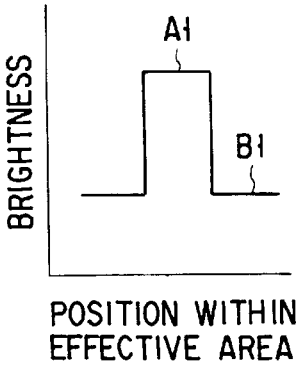
FIGS. 6A to 6C are graphs schematically showing the brightness distribution in the light-emitting portion and non-emitting portion of the phosphor screen included in the color cathode ray tube shown in FIG. 2.
Figure 6B:
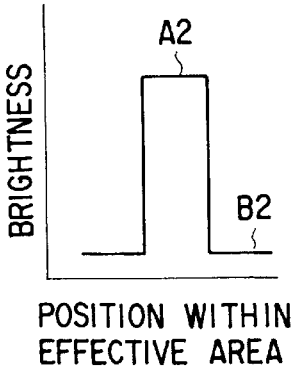

In the ordinary color cathode ray tube, a phosphor layer is formed in direct contact with the inner surface in the effective portion of the panel. In this case, the brightness A1 at the light-emitting portion and the brightness B1 at the non-emitting portion are as shown in FIG. 6A. In the present invention, however, a color filter is formed on the inner surface in the effective portion of the panel. Further, the phosphor layer is formed in contact with the color filter. In this case, the brightness A2 at the light-emitting portion and the brightness B2 at the non-emitting portion are as shown in FIG. 6B. It should be noted that the brightness A2 in the case of using the color filter is substantially equal to the brightness A1 in the case where the color filter is not used. However, the brightness B2 in the case of using the color filter is lower than the brightness B1 in the case where the color filter is not used.

Figure 6C:
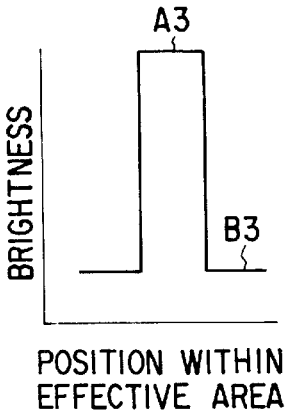

Further, if the maximum transmittance of the glass in the effective portion of the panel is set at 70% or more, which is higher than the maximum transmittance (about 50%) of the glass panel used in the ordinary color cathode ray tube, the color filter as used in the present invention permits the brightness A3 at the light-emitting portion, which is shown in FIG. 6C, to be higher than the brightness A2 shown in FIG. 6B. Also, the brightness B3 at the non-emitting portion, which is shown in FIG. 6C, is substantially equal to or lower than the brightness B1 shown in FIG. 6A.

To reiterate, the transmittance of the glass in the central portion of the effective portion 22 of the panel 20 is set at 70% or more in the color cathode ray tube in this embodiment of the present invention. Also, the three-color phosphor layers 33B, 33G, 33R are formed on the inner surface of the effective portion 22 with the color filters 34B, 34G, 34R interposed therebetween. Clearly, the particular construction of the present invention permits improving the brightness at the light-emitting portion, compared with the conventional color cathode ray tube, and also permits improving the contrast, which is determined by a brightness ratio A/B between the light-emitting portion and the non-emitting portion, compared with the conventional color cathode ray tube.

Figure 7:
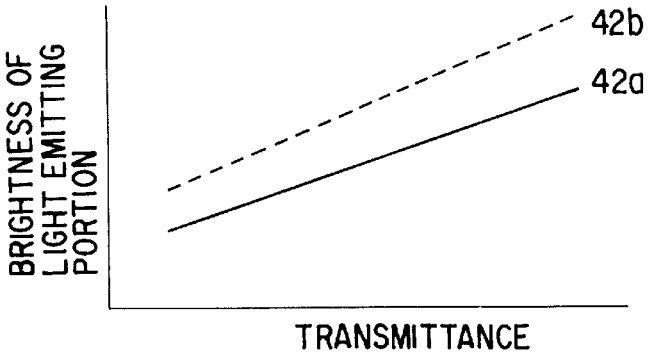
FIG. 7 is a graph showing the relationship between the transmittance in the effective portion of the panel and the brightness in the light-emitting portion of the phosphor screen in respect of the color cathode ray tube shown in FIG. 2.
Figure 8:
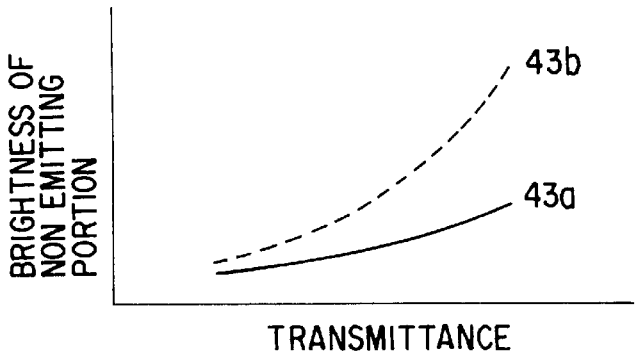
FIG. 8 is a graph showing the relationship between the transmittance in the effective portion of the panel and the brightness in the non-emitting portion of the phosphor screen in respect of the color cathode ray tube shown in FIG. 2.

FIG. 7 shows the relationship between the brightness in the light-emitting portion of the phosphor layer and the transmittance of the glass in the effective portion of the panel. Line 42*a* shown in FIG. 7 represents the case where the phosphor layers are formed on the color filter, with line 42*b* denoting the case where the phosphor layers are formed in direct contact with the inner surface of the panel. On the other hand, FIG. 8 shows the relationship between the brightness in the non-emitting portion (i.e., brightness caused by an external light reflected from the phosphor layer mounted on the inner surface in the effective portion of the panel) and the transmittance of the glass. Curve 43*a* in FIG. 8 covers the case where the phosphor layer is formed on a color filter, with curve 43*b* denoting the case where the phosphor layer is formed without using a color filter. Where the phosphor layer is formed in direct contact with the inner surface of the panel, the brightness in the non-emitting portion is increased rapidly with increase in the transmittance, as denoted by curve 43*b*.

Figure 9:
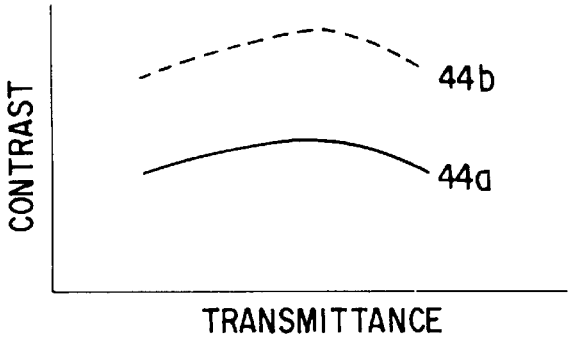
FIG. 9 is a graph showing the relationship between the transmittance in the effective portion of the panel and the contrast of the phosphor screen in respect of the color cathode ray tube shown in FIG. 2.

FIG. 9 is a graph showing the relationship between the contrast, i.e., brightness ratio between the light-emitting portion and the non-emitting portion, and the transmittance of the glass. Curve 44*a* shown in FIG. 9 covers the case where the phosphor layer is formed on a color filter, with curve 44*b* denoting the case where the phosphor layer is formed in direct contact with the inner surface of the panel.

The present inventors have conducted an extensive research on the maximum transmittance of the glass in the effective portion of the panel in view of the increase in the thickness of the panel in the case of flattening the effective portion of the panel. The research has been conducted on the basis of the brightness in the light-emitting portion of the phosphor layer relative to the transmittance of the glass in the effective portion of the panel, the brightness caused by an external light reflected from the phosphor layer, and the contrast. It has been found that it is necessary to set the maximum transmittance of the glass in the central portion of the effective portion of the panel at 70% or more.

A transmittance ratio TR is a ratio of the transmittance Td at the peripheral portion to the transmittance Tc in the central portion of the effective portion of the panel, i.e., TR=Td/Tc. The transmittance ratio TR corresponds to a brightness ratio CB between the central portion in the effective portion of the panel and the edge portions diagonally apart from each other.

Figure 10:
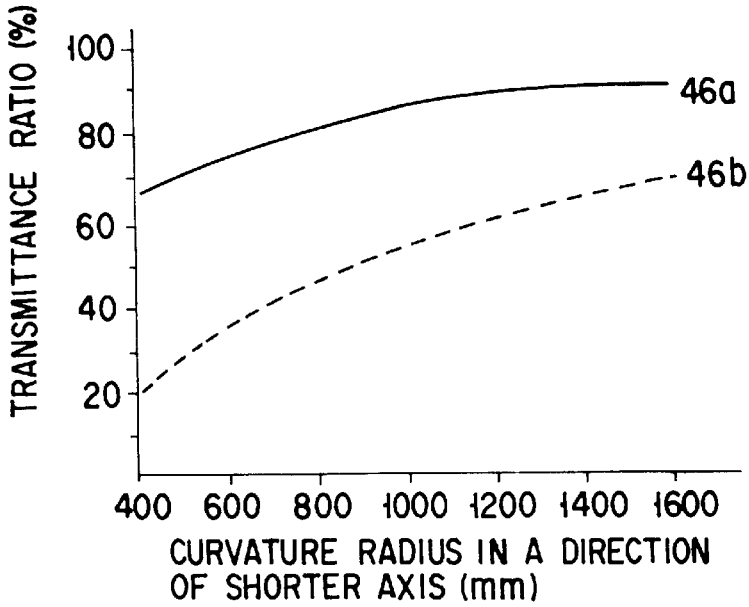
FIG. 10 is a graph showing the relationship between the curvature radius in a direction of the shorter axis in the effective portion of the panel and the transmittance ratio in respect of the color cathode ray tube shown in FIG. 2.

FIG. 10 is a graph showing the relationship between the transmittance ratio TR in the effective portion of the panel and the curvature radius in a direction of the shorter axis of the panel, covering a color cathode ray tube in which the panel has a ratio of a lateral size to a vertical size of 16:9 and a diagonal size of 66 cm. Curve 46*b* shown in FIG. 10 covers the case where the maximum transmittance of the glass is set at 77%, the thickness in the central portion of the effective portion of the panel is set at 13.0 mm, and the inner surface of the effective portion is shaped cylindrical as shown in FIG. 3 such that the curvature radius of the inner surface in a direction of the longer axis is substantially infinitely large and the inner surface has a certain curvature in a direction of the shorter axis. On the other hand, curve 46*b* covers the case where the maximum transmittance of the glass is set at 50%, the thickness in the central portion of the effective portion of the panel is set at 13.0 mm, and the inner surface of the effective portion is shaped cylindrical such that the curvature radius of the inner surface in a direction of the longer axis is substantially infinitely large and the inner surface has a certain curvature in a direction of the shorter axis.

Where the panel has the same ratio of a lateral size to a vertical size and the same diagonal size, the difference in thickness between the central portion in the effective portion of the panel and the edge portions diagonally apart from each other is increased with decrease of the curvature radius in the inner surface of the effective portion. However, if the maximum transmittance of the glass is set at relatively large values as denoted by curve 46*a* in FIG. 10, a change in the transmittance ratio TR between the central portion and the edge portions diagonally apart from each other is small so as to improve the visibility of the phosphor screen, compared with the case where the maximum transmittance of the glass is relatively small, even if the curvature radius of the inner surface of the effective portion is set small in a direction of the shorter axis.

It should also be noted that, in the conventional panel, the inner surface in the effective portion of the panel is shaped spherical or forms a curved plane represented by a polynominal expression of higher degree. In general, the conventional panel has a maximum transmittance of about 50% and a difference in thickness of 3 to 5 mm between the central portion and the peripheral portion in the effective portion of the panel. In this case, the transmittance ratio TR is 86 to 78%. On the other hand, if the transmittance of the glass is set at 70% or more in the central portion in the effective portion of the panel as in this embodiment, the transmittance ratio TR can be set at 88 to 78%, which is nearly equal to that in the conventional panel, even if a difference in thickness is set at 8 to 20 mm between the central portion and the peripheral portion in the effective portion of the panel.

Further, the present inventors have conducted an experiment in an attempt to look into the relationship of the difference in thickness between the central portion in the effective portion of the panel and the edge portions diagonally apart from each other with the mechanical strength of the vacuum envelope for withstanding the atmospheric pressure. The experiment was conducted by setting the pressure outside the vacuum envelope at a level higher than the atmospheric pressure. Table 1 shows the results.

TABLE 1

| Difference in thickness (mm) | 0 | 5 | 8 | 10 | 20 |
|---|---|---|---|---|---|
| Capability of withstanding atmospheric pressure | X | X | X–Δ | ○ | ○ |

Notes:
○: good; Δ: some problem; X: rupture

As apparent from Table 1, the vacuum envelope is enabled to withstand the atmospheric pressure sufficiently, if the difference in thickness between the central portion in the effective portion of the panel and the edge portions diagonally apart from each other is set at 8 mm or more.

In the present invention, the transmittance of the glass in the effective portion 22 of the panel is set at 70% or more, and a difference in thickness between the central portion and the edge portions diagonally apart from each other is set to exceed 8 mm and not to exceed 20 mm. As a result, the present invention makes it possible to provide a color cathode ray tube having a mechanical strength high enough to withstand sufficiently the atmospheric pressure without sacrificing the brightness at the peripheral portion of the panel while maintaining the transmittance ratio TR between the central portion and the edge portions diagonally apart from each other at a level substantially equal to that of the conventional panel.

It is desirable for the shadow mask 24 to be shaped like the inner surface in the effective portion 22 of the panel 20. To be more specific, it is desirable for the effective area 36 of the mask body 37 to be shaped substantially cylindrical such that the curvature radius of the effective area 36 in a direction of the longer axis is substantially infinitely large and the effective area 36 has a certain curvature in a direction of the shorter axis. In addition, the clearance between the effective area 36 of the mask body 37 and the inner surface in the effective portion 22 of the panel 20 can be maintained at an appropriate value by setting the relationship among the drop amount Hp in the inner surface at the edges in a direction of the longer axis relative to the center in the inner surface of the effective portion 22 of the panel 20, the drop amount Vp in the inner surface at the edges in a direction of the shorter axis relative to the center in the inner surface of the effective portion 22, and the drop amount Dp in the inner surface at the edges diagonally apart from each other relative to the center in the inner surface of the effective portion 22 to meet the relationship of: Hp<Vp; Hp<Dp; and by setting the drop amount Hm at the edges in a direction of the longer axis relative to the center in the effective area 36 of the mask body 37, the drop amount Vm at the edges in a direction of the shorter axis relative to the center in the effective area of the mask body 37, and the drop amount Dm at the edges diagonally apart from each other relative to the center in the effective area of the mask body 37 to meet the relationship: Hm<Vm; Hm<Dm.

It should also be noted that the effective area 36 of the shadow mask 24 has a longer side Ll and a shorter side Ls, as apparent from FIG. 5. In addition, the electron beam-passing holes 39 are arranged to form a straight line in a direction of the shorter axis, as denoted by a straight line 49. However, the electron beam-passing holes 39 are not arranged to form a straight line in a direction of the longer axis, but are arranged to form a zigzag line, as apparent from line 49. It follows that, where curvature is imparted to the shadow mask either in a direction of the longer axis or in a direction of the shorter axis, it is more desirable to impart the curvature in a direction of the shorter axis than in a direction of the longer axis in order to increase the mechanical strength for holding the curved surface of the shadow mask. The particular construction makes it possible to suppress the deformation of the shadow mask and the local doming problem during operation of the color cathode ray tube, leading to a color cathode ray tube in which the color purity is unlikely to be deteriorated.

Figure 11:
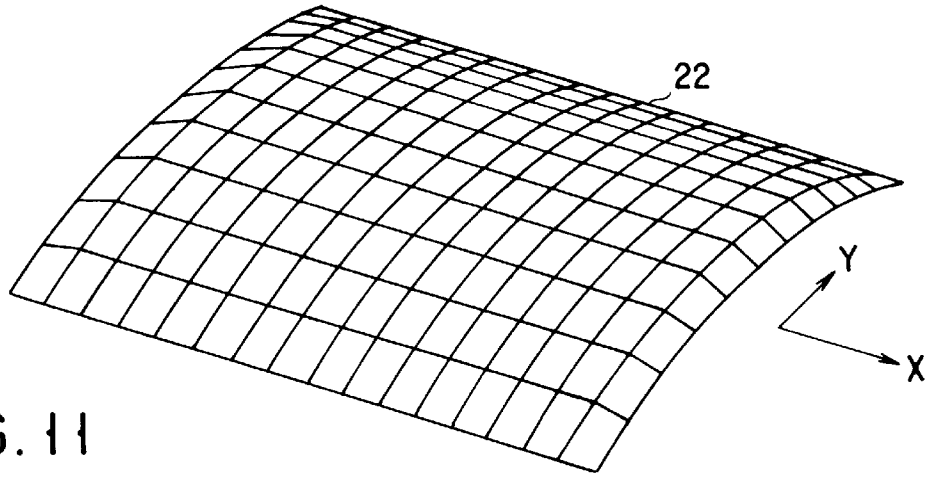
FIG. 11 shows the shape in the inner surface of the effective portion of the panel according to an embodiment of the present invention.

Let us describe a color cathode ray tube according to another embodiment of the present invention with reference to FIG. 11. In the embodiment described previously, the inner surface in the effective portion of the panel is shaped cylindrical such that such that the curvature radius in the inner surface of the effective portion of the panel in a direction of the longer axis is substantially infinitely large and the effective portion of the panel has a certain curvature in a direction of the shorter axis. In the embodiment shown in FIG. 11, however, the inner surface in the effective portion 22 of the panel is shaped such that the curvature radius in a direction of the longer axis is substantially infinitely large in a central portion of the panel, the inner surface is slightly curved in a direction of the longer axis in a peripheral portion of the panel, and the inner surface has a certain curvature in a direction of the shorter axis. In this embodiment, the relationship among the drop amount Hp in the inner surface at the edges in a direction of the longer axis relative to the center in the inner surface of the effective portion 22 of the panel 20, the drop amount Vp in the inner surface at the edges in a direction of the shorter axis relative to the center in the inner surface of the effective portion 22, and the drop amount Dp in the inner surface at the edges diagonally apart from each other relative to the center in the inner surface of the effective portion 22 to meet the relationship of: Hp<Vp; Hp<Dp.

Figure 12:
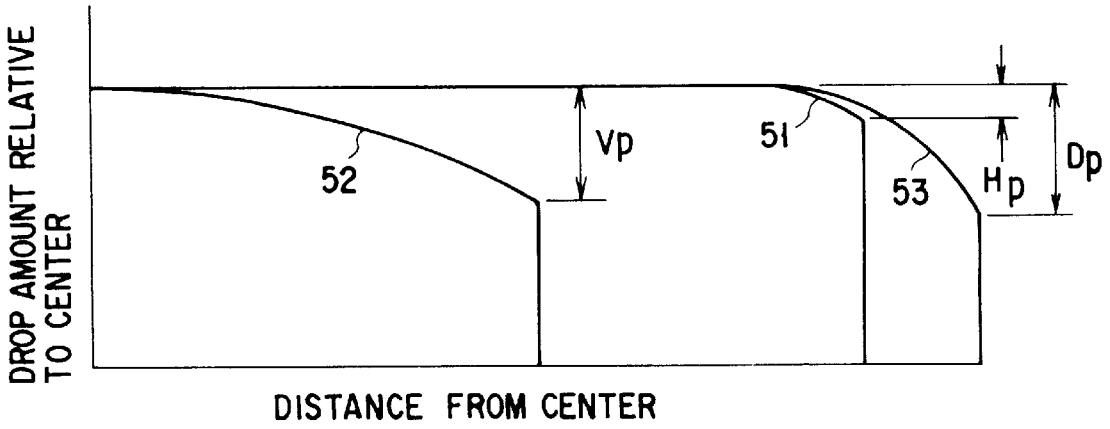
FIG. 12 shows the drop amount at the peripheral portion relative to the center in the effective portion of the panel according to another embodiment of the present invention.

FIG. 12 is a graph showing a curve 51 denoting how the drop amount in the inner surface of the panel is changed in a direction of the longer axis, a curve 52 denoting how the drop amount in the inner surface of the panel is changed in a direction of the shorter axis, and a curve 53 denoting how the drop amount in the inner surface of the panel is changed in a diagonal direction. As an example, the values of Hp, Vp and Dp are as follows:

Hp=4.0 mm; Vp=13.0 mm; Dp=13.5 mm

The effective area in the mask body of the shadow mask is shaped to conform with the inner surface in the effective portion of the panel. Naturally, the clearance between the effective area 36 of the mask body 37 and the inner surface in the effective portion 22 of the panel 20 can be maintained at an appropriate value by setting the drop amount Hm at the edges in a direction of the longer axis relative to the center in the effective area 36 of the mask body 37, the drop amount Vm at the edges in a direction of the shorter axis relative to the center in the effective area of the mask body 37, and the drop amount Dm at the edges diagonally apart from each other relative to the center in the effective area of the mask body 37 to meet the relationship: Hm<Vm; Hm<Dm.

It is particularly important to note that, in the color cathode ray tube of the construction described above, the effective area of the mask body is curved in the peripheral portion in a direction of the longer axis, making it possible to increase the mechanical strength for holding the curved surface of the shadow mask so as to suppress effectively the deformation and local doming problem of the shadow mask. It follows that the color purity is unlikely to be deteriorated in the color cathode ray tube.

In each of the embodiments described above, a filter is mounted on the inner surface in the effective portion of the panel. However, if a high importance is attached to the brightness around the central portion of the panel, it is not absolutely necessary to mount the filter on the inner surface. Even in this case, it is possible to ensure a mechanical strength of the vacuum envelope high enough to sufficiently withstand the atmospheric pressure and to ensure a sufficient brightness at peripheral portion in the effective portion of the panel, while suppressing the deterioration of the color purity caused by the deformation or local doming problem of the shadow mask.

It is also possible to mount a filter for changing the transmittance of the glass on the outer surface in the effective portion of the panel so as to improve the contrast of the color cathode ray tube. The filter may be of the type which selectively transmits the light beams emitted from the three-color phosphor layers. Also, the outer surface of the panel may be coated with a film having a filter.

Further, it is possible to mount a filter which selectively transmits the light beams emitted from the three-color phosphor layers on each of the inner surface and the outer surface in the effective portion of the panel so as to provide a color cathode ray tube in which the contrast and the color purity are unlikely to be deteriorated.

In each of the embodiments described above, the mask body of the shadow mask is provided with a plurality of slit-shaped electron beam-passing holes which are linearly arranged to form columns with bridge portions interposed between the adjacent beam-passing holes. However, the electron beam-passing hole may be shaped circular.

As described above, the present invention provides a color cathode ray tube which comprises a panel having a substantially flat or slightly curved outer surface in the effective portion so as to enable the vacuum envelope to exhibit a mechanical strength high enough to withstand the atmospheric pressure while improving the visibility of the phosphor screen. In addition, a high brightness can be ensured at the peripheral portion of the panel. Further, the color purity is unlikely to be deteriorated by the deformation and local doming problem of the shadow mask in the color cathode ray tube of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube, comprising:

a panel made of glass and having a substantially rectangular effective portion;

a phosphor screen formed on the inner surface of the effective portion of the panel and consisting of three-color phosphor layers; and a shadow mask positioned to face the phosphor screen and having a large number of electron beam passing-holes formed in a substantially rectangular effective portion thereof, wherein the outer surface in the effective portion of the panel is substantially flat or forms a slightly curved plane with a small curvature, a difference in thickness of the effective portion of the panel between the central portion and the edge portions diagonally apart from each other exceeds 8 mm and does not exceed 20 mm, and the transmittance of the glass in the central portion of the effective portion is at least 70%.

2. The color cathode ray tube according to claim 1, wherein a filter selectively transmitting the light rays emitted from the three-color phosphor layers is formed on the inner surface in the effective portion of the panel, and the three-color phosphor layers are formed on said filter.

3. The color cathode ray tube according to claim 1, wherein a filter which changes the transmittance of the glass is formed on the outer surface in the effective portion of the panel.

4. The color cathode ray tube according to claim 1, wherein the inner surface of the panel has a substantially infinite curvature radius in a direction of the longer axis in at least a central portion of the panel and is curved in a direction of the shorter axis.

5. The color cathode ray tube according to claim 4, wherein a filter selectively transmitting the colored light beams emitted from the three-color phosphor layers is formed on the inner surface in the effective portion of the panel, and the three-color phosphor layers are formed on said filter.

6. The color cathode ray tube according to claim 4, wherein a filter which changes the transmittance of the glass is arranged on the outer surface of the effective portion of the panel.

7. The color cathode ray tube according to claim 4, wherein the inner surface in the effective portion of the panel is slightly curved in a direction of the longer axis in edge portions in a direction of the longer axis.

8. The color cathode ray tube according to claim 4, wherein a drop amount Hp in the inner surface at the edges in a direction of the longer axis relative to the inner surface in the central portion of the effective area of the panel, a drop amount Vp in the inner surface at the edges in a direction of the shorter axis relative to the inner surface in the central portion of the effective area of the panel, and a drop amount Dp in the inner surface at the edges diagonally apart from each other relative to the inner surface in the central portion of the effective area of the panel are set to meet the relationship: $Hp<Vp$; $Hp<Dp$.

9. The color cathode ray tube according to claim 1, wherein the effective portion of the shadow mask has a substantially infinite curvature radius in at least a central portion in a direction of the longer axis and is curved in a direction of the shorter axis.

10. The color cathode ray tube according to claim 1, wherein a drop amount Hm at the edges in a direction of the longer axis relative to the center of the effective portion of the shadow mask, a drop amount Vm at the edges in a direction of the shorter axis relative to the center of the effective portion of the shadow mask, and a drop amount Dm at the edges diagonally apart from each other relative to the center of the effective portion of the shadow mask are set to meet the relationship: $Hm<Vm$; $Hm<Dm$.

* * * * *